US011225311B2

(12) United States Patent
Arrouy et al.

(10) Patent No.: US 11,225,311 B2
(45) Date of Patent: Jan. 18, 2022

(54) SYSTEM COMPRISING A TETHERED SAIL AND A FIXED STATION HAVING MEANS FOR FOLDING THE SAIL AT THE FIXED STATION

(71) Applicant: AIRSEAS, Toulouse (FR)

(72) Inventors: Pascal Arrouy, Aucamville (FR); Jeremy Braines, Pibrac (FR); Emmanuel Cortet, Le Haillan (FR); Benoit Gagnaire, Fonsorbes (FR); Jean-Marc Ortega, Blagnac (FR); Jérôme Rigaud, Coufouleux (FR); Vianney Hiver, Toulouse (FR)

(73) Assignee: AIRSEAS, Toulouse (FR)

( * ) Notice: Subject to any disclaimer, the term of this patent is extended or adjusted under 35 U.S.C. 154(b) by 0 days.

(21) Appl. No.: 16/973,965

(22) PCT Filed: Jun. 7, 2019

(86) PCT No.: PCT/FR2019/051388

§ 371 (c)(1),
(2) Date: Dec. 10, 2020

(87) PCT Pub. No.: WO2019/239044

PCT Pub. Date: Dec. 19, 2019

(65) Prior Publication Data

US 2021/0253210 A1 Aug. 19, 2021

(51) Int. Cl.
*B63H 9/06* (2020.01)
*B63H 9/072* (2020.01)
(Continued)

(52) U.S. Cl.
CPC ..... *B63H 9/072* (2020.02); *B63B 15/0083* (2013.01); *B63H 9/071* (2020.02); *B63H 9/1021* (2013.01); *B63B 2035/009* (2013.01)

(58) Field of Classification Search
CPC ..... B63H 9/072; B63H 9/071; B63H 9/1021; B63H 8/50; B63H 9/0673; B63H 9/069; B63B 15/0083
See application file for complete search history.

(56) References Cited

U.S. PATENT DOCUMENTS 7,287,481 B1 * 10/2007 Wrage ..... B63H 9/069 114/102.29
9,353,033 B2 * 5/2016 Vander Lind ..... B64D 3/00
(Continued)

FOREIGN PATENT DOCUMENTS

CN 101786498 A 7/2010
EP 2193075 A1 6/2010
(Continued)

OTHER PUBLICATIONS

Search Report issued in French Patent Application No. 1855078 dated Jan. 30, 2019.
(Continued)

*Primary Examiner* — Andrew Polay
(74) *Attorney, Agent, or Firm* — Pearne & Gordon LLP

(57) ABSTRACT

A traction system for a watercraft, including a sail and a fixed station that includes a mast and a winch which is connected to the sail by a traction cable, the system further including a bottom part that is supported by the traction cable, and fold lines, each of which has an end that is attached to a leading edge of the sail, and another end that is supported by the bottom part. The fixed station includes a base that accommodates the bottom element when the sail is retracted by the winch; and structure for grasping each fold line and pulling same towards the mast so as to retract the leading edge against the mast and fold the sail once the winch has retracted same close to the station.

8 Claims, 6 Drawing Sheets

(51) Int. Cl.

| | |
|---|---|
| ***B63H 9/071*** | (2020.01) |
| ***B63B 15/00*** | (2006.01) |
| ***B63H 9/10*** | (2006.01) |
| *B63B 35/00* | (2020.01) |

(56) References Cited

U.S. PATENT DOCUMENTS

| | | | | |
|---|---|---|---|---|
| 2004/0099196 | A1* | 5/2004 | Grenier | B63H 9/069<br>114/102.16 |
| 2011/0041747 | A1* | 2/2011 | Reusch | B63H 9/072<br>114/39.11 |

FOREIGN PATENT DOCUMENTS

| | | | |
|---|---|---|---|
| FR | 2940783 | A1 | 7/2010 |
| WO | 2009026939 | A1 | 3/2009 |

OTHER PUBLICATIONS

International Search Report for Application No. PCT/FR2019/051388 dated Dec. 5, 2019.
Written Opinion for PCT/FR2019/051388 dated Dec. 5, 2019.

* cited by examiner

SYSTEM COMPRISING A TETHERED SAIL AND A FIXED STATION HAVING MEANS FOR FOLDING THE SAIL AT THE FIXED STATION

This is the National Stage of PCT international application PCT/FR2019/051388, filed on Jun. 7, 2019 entitled "SYSTEM COMPRISING A TETHERED SAIL AND A FIXED STATION HAVING MEANS FOR FOLDING THE SAIL AT THE FIXED STATION", which claims the priority of French Patent Application No. 1855078 filed Jun. 11, 2018, both of which are incorporated herein by reference in their entirety.

TECHNICAL FIELD

The invention relates to a system comprising a fixed station to which is connected a tethered sail with means for bringing the sail back to the fixed station and for folding this sail.

PRIOR ART

The invention more particularly relates to a system comprising a fixed station and a sail, of the type of the sails used in kite-surfing or paragliding, which is said to be tethered, i.e. connected by a traction cable to this fixed station. In practice, the fixed station is installed on a deck of a ship to which it is rigidly secured, and the sail which comprises a flexible wing with different control and connection lines at the traction cable is deployed by being attached to this fixed station, in order to tow the ship.

Such a traction system can also be used as an energy converter: the fixed station is then installed on the ground, and the sail drives an electric generator rotated by the displacement of the cable due to the traction of the sail under the effect of the wind.

When such an installation is intended to equip a ship, this is typically a commercial ship of the cargo type, in order to provide it with traction, additionally to the motorised propulsion system of this ship, which makes it possible to significantly reduce the fuel consumption.

With such an installation, it is necessary to be able to easily deploy the sail when the wind has a satisfactory orientation and force, and to be able to bring it back and fold it for example when the weather conditions are no longer suitable.

In this framework, the fixed station is fitted with a winch that makes it possible to take out and bring back the sail automatically, and it also comprises a vertical mast along which the sail has to be placed once it has been brought back.

Such a sail having a large size when it is sized for a ship of the cargo type, it is necessary to provide means for folding it along the mast easily, quickly and safely. Indeed, when a such a sail has a span of fifty metres or more, its span and its mass make folding it a problem, which is further accentuated by the fact that a commercial ship does not have a crew that is numerous enough and competent to carry out such an operation.

The purpose of the invention is to provide a solution to simplify the folding of such a sail on the mast of the fixed station once it has been brought back to this fixed station.

DISCLOSURE OF THE INVENTION

To this effect, the invention has for object a traction system, notably for a ship, comprising a sail and a fixed station including a mast and a winch connected to the sail by a traction cable, comprising:

- several folding lines each one having an end fastened to a leading edge of the sail by being spaced apart from one another along this leading edge;
- means for pulling at least three folding lines, so as to bring back the ends of these folding lines fastened to the leading edge against the mast at at least two different heights along this mast.

With this arrangement, when the large-size sail has been brought back to the fixed station, the folding lines permanently installed on the wing of this sail make it possible to fold it from the deck.

The invention also relates to such a system comprising:

- a base unit carried by the traction cable, each folding line having an end carried by this base unit;
- a socket fitted to the fixed station and receiving the base unit when the sail is brought back by the winch;
- deflection members such as pulleys or snap hooks fitted to the mast to receive the folding lines;
- means for pulling each folding line received in a deflection member, so as to bring back the upper end of each folding line against the mast.

The invention also relates to such a system, wherein the means for pulling each folding line comprise control lines that run alongside the mast by having passed through the deflection members before bringing the sail back with the winch, these control lines then being connected to the folding lines to pull on these folding lines.

The invention also relates to such a system, wherein the fixed station comprises a plate and wherein each control line comprises an end fitted with a connection member fastened to this plate on hold before bringing the sail back with the winch.

The invention also relates to such a system, wherein the fixed station comprises winches to pull on each control line.

The invention also relates to such a system, wherein each control line has an end fitted with a connection member at an end of a folding line.

The invention also relates to such a system, wherein each control line has an end fitted with a connection member to a folding line portion located between the ends of this folding line.

The invention also relates to such a system, wherein the mast is fitted with sliders each carrying a deflection member able to be connected to a folding line portion located between the ends of this folding line by surrounding it, each slider being mobile along the mast, and means for pulling folding lines received in a connection member.

DETAILED DISCLOSURE OF PARTICULAR EMBODIMENTS

Figure 1:
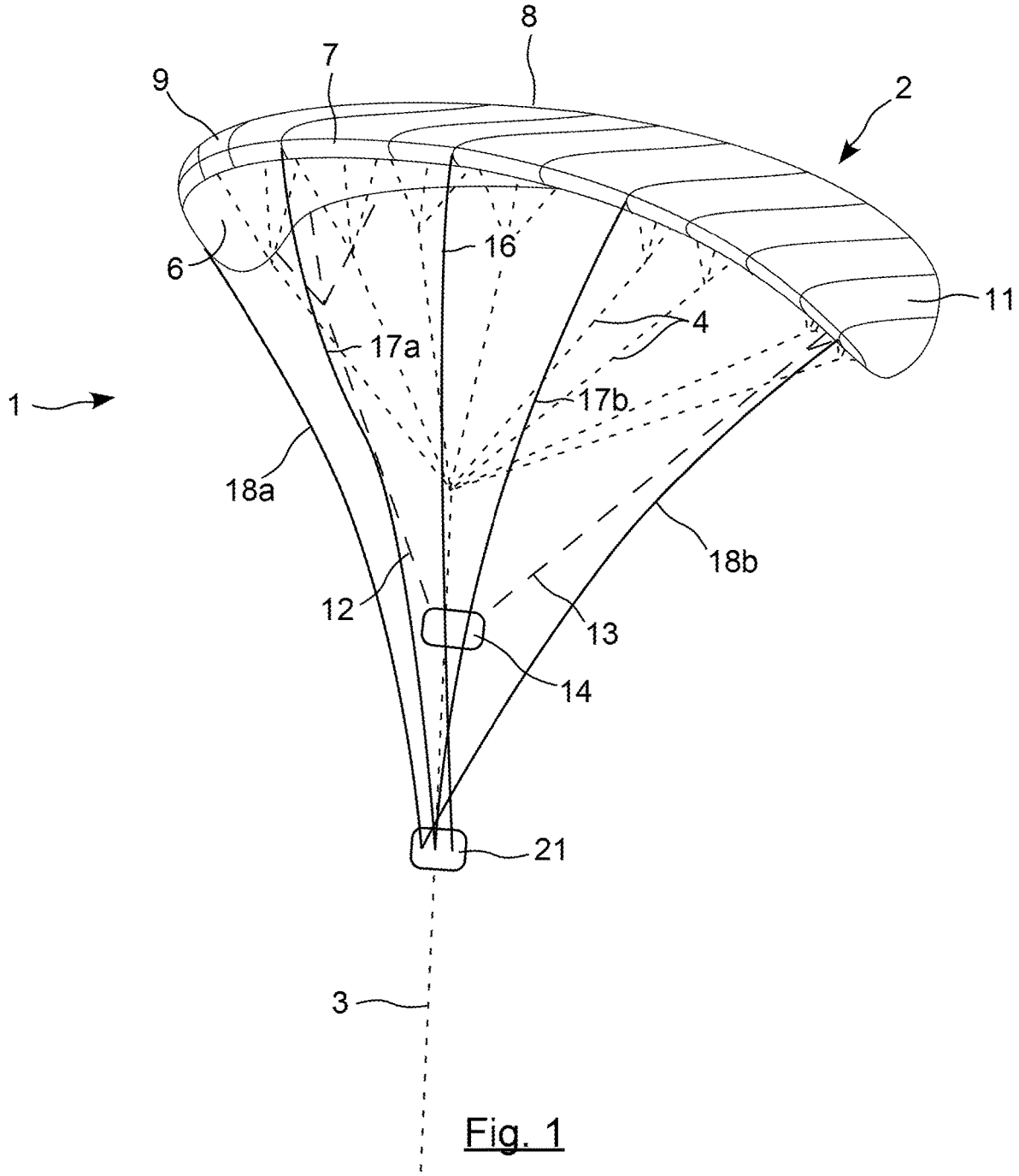
FIG. 1 is an overview of a sail according to the invention.

In FIG. 1, a sail 1 in accordance with the invention comprises a flexible wing 2 connected to a traction cable 3 by a set of hangers 4 each having an end connected to a lower face 6 of the wing 2 and another end connected to an end of the traction cable 3.

The wing 2 has a general oblong shape comprising a leading edge 7 and a trailing edge 8 extending from a left side 9 to a right side 11 of this wing, the right and left sides being considered as in FIG. 1, i.e. for an observer located facing the sail and with their back to the wind. This wing is formed from several portions of canvas or fabric assembled to have a profile and an arch that are suitable for obtaining a suitable lift when this wing is in a flow of air. This sail 1 is also fitted with two lateral sheets 12, 13 that have their ends fastened respectively to the left 9 and right 11 sides of the wing, their other ends being maintained by a control member 14 carried by the traction cable 3.

This sail is also fitted with a central upper folding line 16, a median pair of lateral folding lines 17*a*, 17*b* and a lower pair of lateral folding lines 18*a*, 18*b*. The upper folding line 16 comprises an upper end fastened to the middle of the leading edge 7, and a lower end carried by a base unit 21 which is itself carried by the traction cable 3.

The median lateral line 17*a* comprises an upper end fastened mid-way between the middle and the left end of the leading edge 7, and a lower end carried by the base unit 21. The median lateral line 17*b* is symmetric with the line 17*a* by comprising an end fastened mid-way between the middle and the right end of the leading edge, and another end carried by the base unit 21.

The lower lateral line 18*a* comprises an upper end fastened to the left end of the leading edge 7, and a lower end carried by the base unit 21. The lower lateral line 18*b* is symmetric with the line 18*a*, with an end fastened to the right end of the leading edge 7, and another end carried by the base unit 21.

Figure 2:
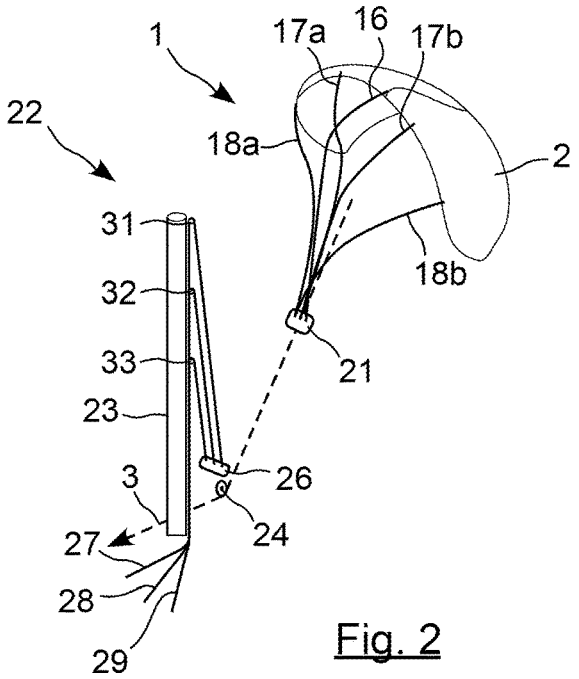
FIG. 2 is an overview of a sail approaching the fixed station according to the invention.

This sail 1 is connected by the cable 3 to a fixed station marked by 22 in FIG. 2, which is fitted on a deck of a ship not shown, to form a unit able to tow the ship for example in addition to a propulsion system fitted on this ship.

The fixed station 22 comprises a mast 23 extending vertically and it is fitted at its base with a winch not shown to which the traction cable 3 is attached, this cable 3 passing through a pulley 24 located in the vicinity of the base of the mast. This fixed station 22 also comprises a plate 26 located in the vicinity of the base of the mast and of the pulley 24, as well as three control lines 27, 28 and 29, referred to respectively as upper, median and lower, making it possible to fold the sail along the mast 23.

The upper control line 27 comprises an end connected to a control member of the winch type not shown located in the vicinity of the base of the mast, and it runs alongside this mast 23 to pass through a deflection member, here an upper pulley 31, carried by the upper end of the mast, and it extends to the plate 26 which maintains the other end thereof.

The median control line 28 also comprises an end connected to another winch not shown and located in the vicinity of the base of the mast. It runs alongside this mast 23 to pass through a deflection member, here a median pulley 32 carried by the mast to about three-quarters of its height, and it extends to the plate 26 which maintains the other end thereof.

The lower control line 29 also comprises an end connected to another control member of the winch type not shown located in the vicinity of the base of the mast. It runs alongside this mast 23 to pass through a deflection member, here a lower pulley 33, carried by the mast to about half of its height, and it extends to the plate 26 which maintains the other end thereof.

Figure 3:
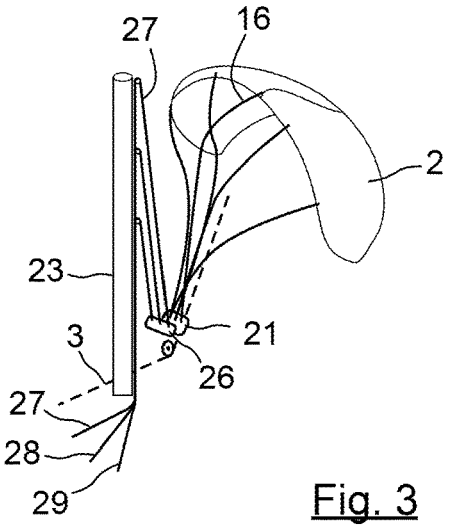
FIG. 3 is an overview of a sail brought back to the fixed station according to the invention.

The return of the sail 1 to the fixed station 22 is provided by actuating the winch of the traction cable 3, which corresponds to the situation of FIG. 2, until the base unit 21 of this sail is at the height of the plate 26, as shown in FIG. 3.

Figure 7:
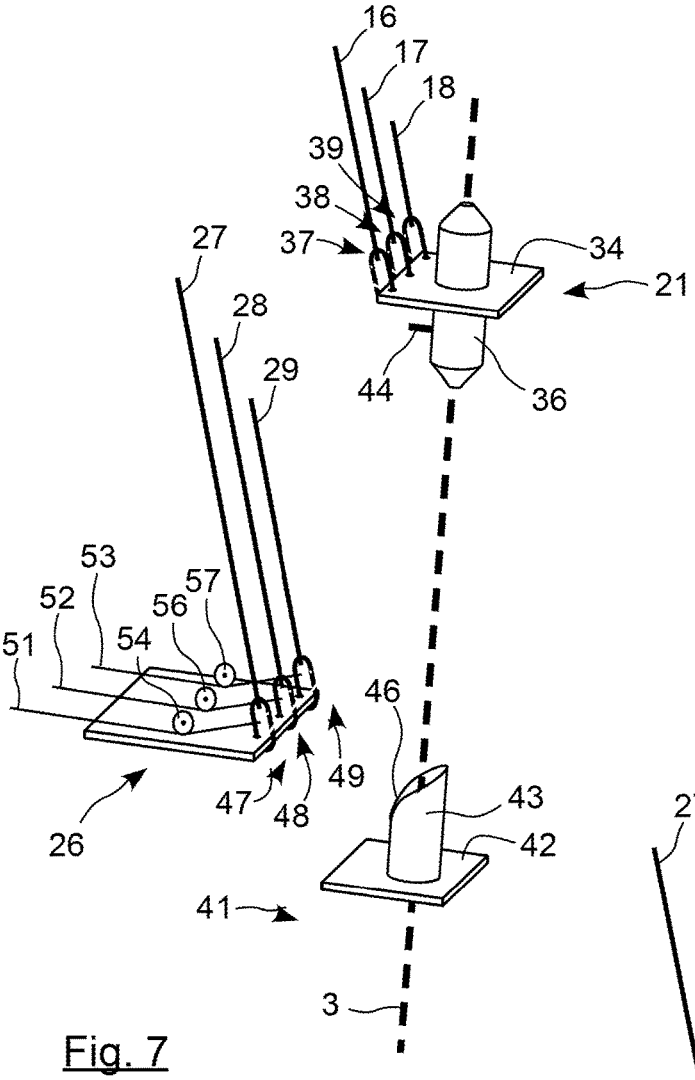
FIG. 7 is an overview showing a plate as well as a socket and a base unit on the approach in the system according to the invention.

As can be seen in FIG. 7, the base unit 21 comprises a plate 34 rigidly secured to a generally cylindrical sheath 36 that passes through the central region thereof, this sheath 36 being oriented perpendicularly to the plate 34 and being itself passed through by the traction cable 3 to which it is rigidly secured.

Each folding line 16, 17*a*, 17*b*, 18*a*, 18*b* has its end maintained at the base unit 21 thanks to a snap hook carried by this end and which is engaged in a corresponding hole formed in the plate 34. In the example of FIG. 7, the plate 34 has a square contour and it comprises three holes along one of its edges, these holes respectively receiving the three snap hooks 37, 38, 39 which are each carried by an end of the folding line.

The first snap hook 37 is carried by an end of the upper folding line 16, the second snap hook 38 is carried by the ends of the folding lines 17*a* and 17*b*, and the third snap hook 39 is carried by the ends of the folding lines 18*a* and 18*b*.

The folding lines 17*a* and 17*b* of the median pair of folding lines noted as 17 here have their ends connected at the second snap hook 38, this median pair 17 also able to have the shape of a Y-shaped cable. The same applies for the lines 18*a* and 18*b* of the lower pair of folding lines marked by 18, of which the ends are connected at the third snap hook 39.

Figure 8:
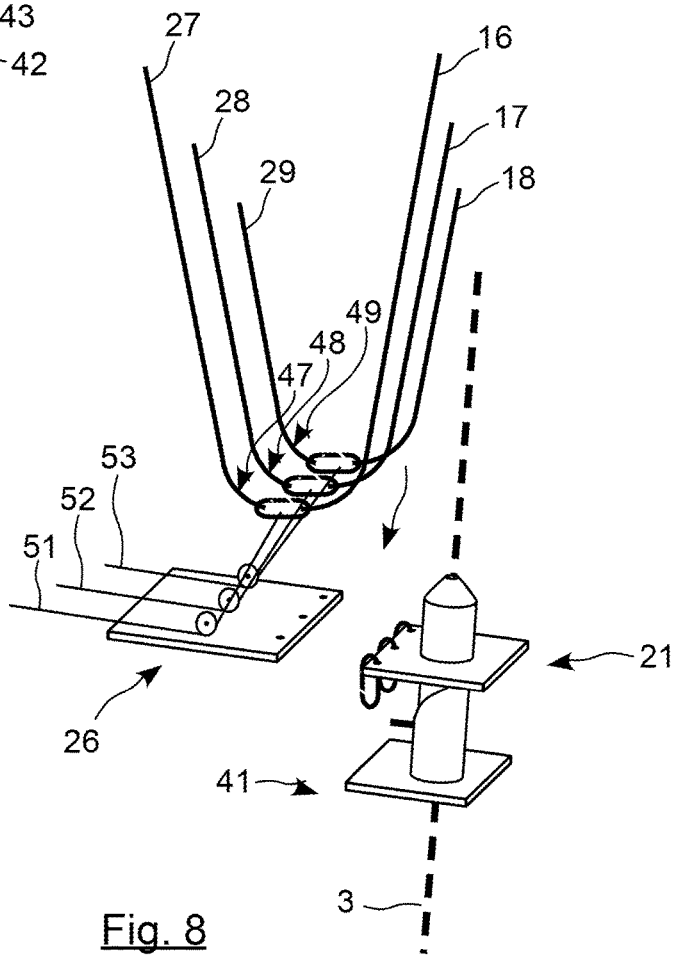
FIG. 8 is an overview showing a plate as well as a socket and a base unit in place in the system according to the invention.

As can be seen in FIGS. 7 and 8, the station 22 is also fitted with a fixed socket 41 for receiving the base unit 21.

This socket 41 comprises a support plate 42 pierced at its centre and carrying at its upper face a tubular channeler 43. The plate 42 and the channeler 43 are passed through by the traction cable 3 that can slide in the socket.

At the end of the approach of the sail, the sheath 36 engages in the channeler 43 by its lower portion, in such a way that the base unit 21 is then precisely positioned at the height of the plate 26, i.e. facing the latter. In this situation, the base unit 21 is also precisely oriented with respect to the plate 26, thanks to a lug 44 radially exceeding a lower portion of the sheath 36, and engaging in a corresponding notch 46 of the channeler when the sheath is nested in this channeler.

As can be seen in FIGS. 7 and 8, the control lines 27, 28 and 29 have their ends maintained at the plate 26 by three other snap hooks 47, 48, 49. This plate 26 here has the general shape of a rectangular plate including three holes along it edge located facing the plate 34 of the base unit 21, these three holes receiving the snap hooks 47-49.

The upper control line 27 has its end connected to the fourth snap hook 47, the median control line 28 has its end connected to the fifth snap hook 48, and the lower control line 29 has its end connected to the sixth snap hook 49.

Additionally, the fixed station 22 further comprises an upper return line 51, a median return line 52, and a lower return line 53 of which the ends are connected respectively to the snap hooks 47, 48 and 49. Each return line passes in a corresponding pulley and has its opposite end connected to a control member of the winch type not shown. These pulleys 54, 56 and 57 are carried by the plate 26.

When the base unit of the sail 1 has been brought back completely, the ends of the folding lines 16-18 are connected to the ends of the control lines 27-28, respectively by the snap hooks 47-49. Concretely, an operator or an apparatus detaches the end of the upper folding line 16 from its snap hook 37, and it passes this end in the snap hook 47. The same operation is carried out for the pairs of folding lines 17 and 18 in order to connect their ends to the control lines 28 and 29, respectively, which corresponds to the situation shown in FIG. 8.

Once the control lines 27-29 have been connected to the folding lines 16-18, respectively by the snap hooks 47-49, the winch is actuated to complete the descent of the entire sail, so as to be able to begin the folding operations of the wing 2 along the mast 23.

Figure 4:
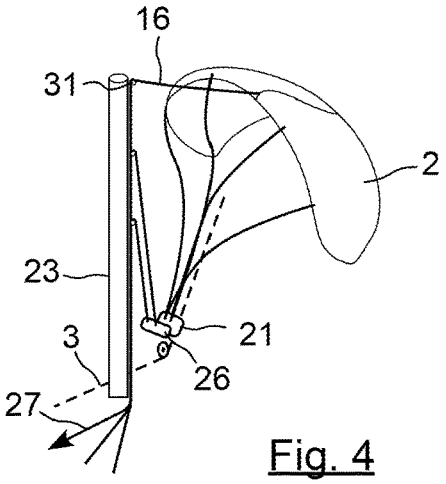
FIG. 4 is an overview of a sail at the beginning of the folding operation in accordance with the invention.
Figure 5:
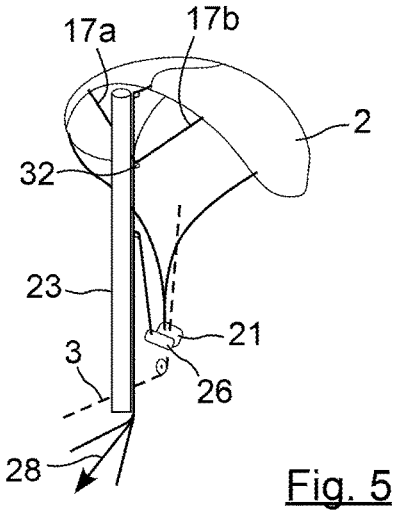
FIG. 5 is a sail during the folding operation in accordance with the invention.

The upper control line 27, connected to the upper folding line 16, is then pulled from the base of the mast 23, as shown in FIG. 4, to come closer to the middle of the leading edge to which the line 16 is fastened, against the upper pulley 31, i.e. against the upper end of the mast 23, which corresponds to the situation of FIG. 5.

As will have been understood, when the line 27 is pulled, the snap hook 47 passes through the deflection member that the upper pulley 31 forms wherein the upper folding line 16 is then engaged.

At this stage, the upper control line 27 is blocked, for example with a tappet, and the median control line 28, which is connected to the median pair 17 of folding lines 17*a*, 17*b*, is in turn pulled from the base of the mast 23, as diagrammatically shown in FIG. 5. This makes it possible to bring back the left portion and the right portion of the leading edge against the median pulley 32, i.e. against the mast. This line 28 is then blocked. Here too, the snap hook 48 passes through the deflection member that the median pulley 32 forms wherein the folded lines of the pair 17 are then engaged.

The lower control line 29, which is connected to the lower pair 18 of folding lines 18*a* and 18*b* is then pulled in turn, to bring back the left and right ends of the wing 2 against the lower pulley 33, before blocking this line 29. Here too, the snap hook 49 passes through the deflection member that the lower pulley 33 forms wherein the folded lines of the pair 18 are then engaged.

Figure 6:
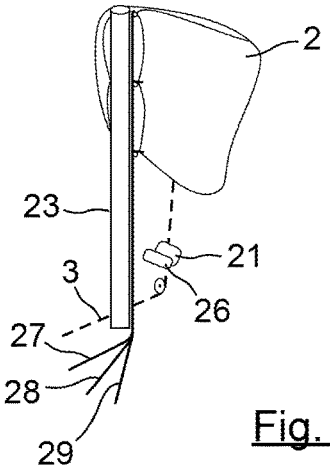
FIG. 6 is a folded sail according to the invention.

In this situation shown in FIG. 6, the wing 2 is folded against the mast 23, i.e. folded in two with the centre of its leading edge against the upper end of the mast 23, the left and right halves of its leading edge extending parallel to one another along the mast 23 by being maintained to the latter against the pulleys 31-33.

In the explanation that has just been given on folding, the three control lines were actuated one after the other to facilitate the understanding of the process, but these lines can also be actuated simultaneously or according to a different sequence consisting mainly in pulling all of them to fold the wing against the mast.

In the first embodiment of the invention which is shown in FIGS. 2 to 4, the ends of the control lines 27-29 are connected to the ends of the folding lines 16-18 to bring the leading edge folded against the mast 23, but the control lines can also be used differently as in the case of the second embodiment of the invention.

Figure 9:
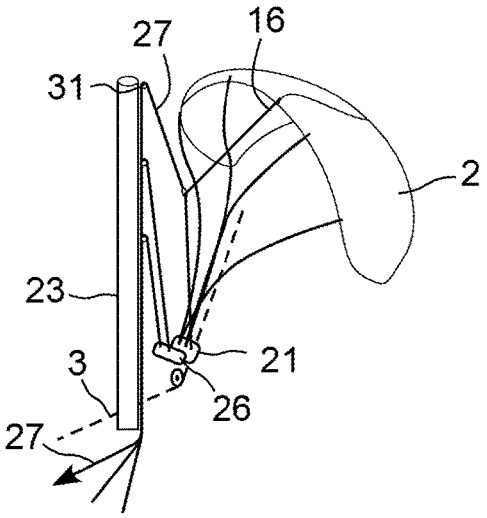
FIG. 9 is an overview of a sail at the beginning of the folding operation according to a second embodiment of the invention.
Figure 10:
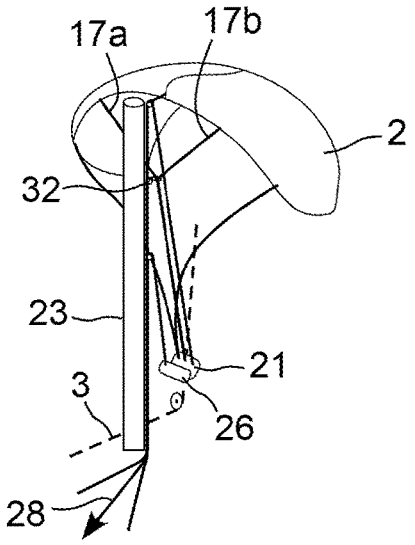
FIG. 10 is an overview of a sail during the folding operation according to the second embodiment of the invention.

In this second embodiment which is shown in FIGS. 9 and 10, the folding lines 16-18 are not uncoupled from the base unit 21 to fold the wing. When the base unit of the sail has been brought back to the fixed station as in FIG. 9, the lower end of the upper control line 27 is detached from the plate 26 in order to be passed around the upper folding line 16 which remains fastened by its end to the base unit 21. In other words, the fourth snap hook 47 terminating the control line 27 is detached from the plate 26 in order to be passed around the upper folding line 16, without detaching the latter from the base unit.

The upper control line 27 is then actuated to bring back the middle of the leading edge of the wing against the upper pulley 31, as in FIG. 10. As will have been understood, when the line 27 is pulled, the snap hook 47 passes through the deflection member formed by the upper pulley 31 wherein the upper folding line 16 folded in two is then engaged.

Similarly, the fifth snap hook 48 terminating the median control line 28 is then detached from the plate 26 to be passed around the pair of median folding lines 17, without detaching the latter from the base unit. The median control line can then be pulled to bring back the sides of the leading edge against the mast, as diagrammatically shown in FIG. 10. Here too, the snap hook 48 passes through the deflection member that the median pulley 32 forms wherein the folded lines of the median pair 17 are then engaged.

Finally, the sixth snap hook 49 terminating the lower control line 29 is detached from the plate 26 and passed around the pair of lower folding lines 18, without detaching them from the base unit. The lower control line can then be pulled to bring back the ends of the wing against the mast. Here too, the snap hook 49 passes through the deflection member that the lower pulley 33 forms wherein the folded lines of the lower pair 18 are then engaged.

When the line 29 has been fully pulled, the sail is folded against the mast, according to a configuration identical to that of FIG. 6.

In the third embodiment, which is shown in FIGS. 11 to 15, the mast is fitted with an upper slider 61, a median slider 62 and a lower slider 63, which can be displaced along this mast 23. Each slider 61-63 is fitted with a deflection member, here a snap hook, and the folding is provided only with the folding lines. In this third embodiment, the folding lines 16-18 are not detached from the base unit 21 to fold the sail on the mast.

Figure 11:
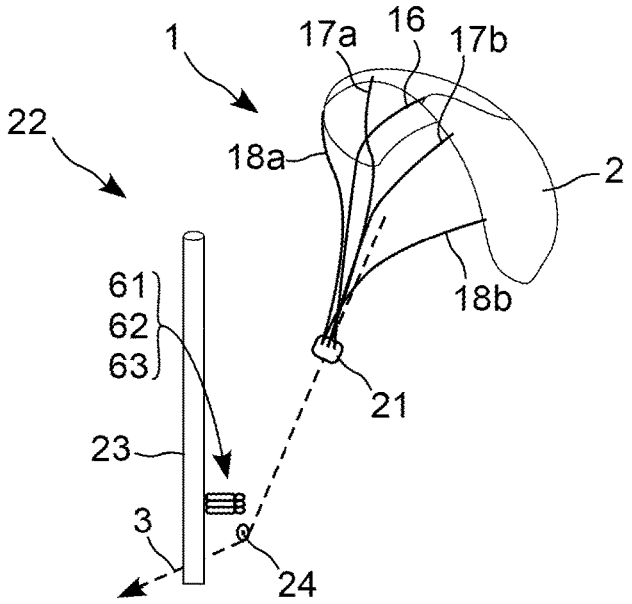
FIG. 11 is an overview of a sail approaching the fixed station according to a third embodiment of the invention.
Figure 12:
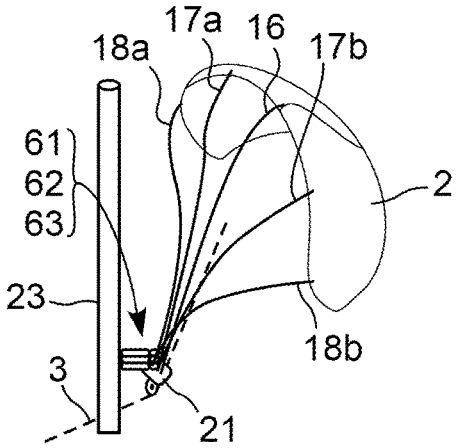
FIG. 12 is an overview of a sail brought back to the fixed station according to the third embodiment of the invention.

These sliders 61-63 are positioned in the lower portion of the mast 23 before folding of the wing, such as for example during the approach thereof as in FIG. 11. These sliders are more particularly positioned to be facing the base unit 21 when the sail is brought back to the fixed station as in FIG. 12.

Figure 13:
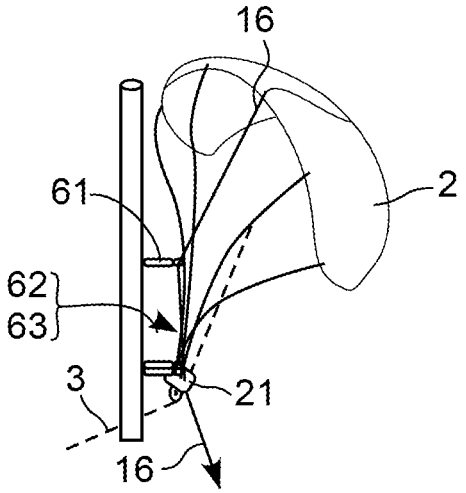
FIG. 13 is an overview of a sail at the beginning of the folding operation according to the third embodiment of the invention.

At this stage, the snap hook fitted on the end of the upper slider is passed around the upper folding line 16, and it is displaced along the mast until it reaches the top thereof. Additionally, the upper folding line 16 is pulled downwards by its lower end, as shown in FIG. 13. The lower end of the line 16 passes for example through the base unit 21 to be made secure to the latter, while still able to be pulled from the lower face of this base unit 21 in such a way as to slide through the latter.

Figure 14:
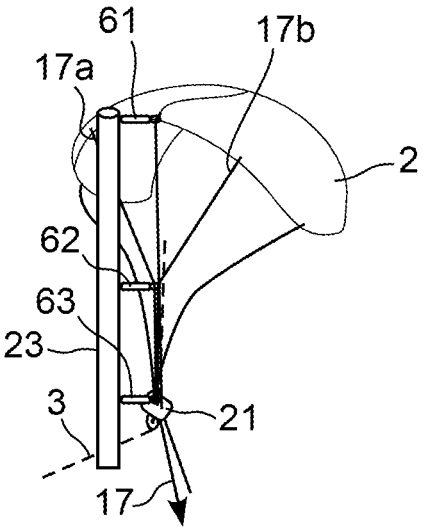
FIG. 14 is a sail during the folding operation according to the third embodiment of the invention.
Figure 15:
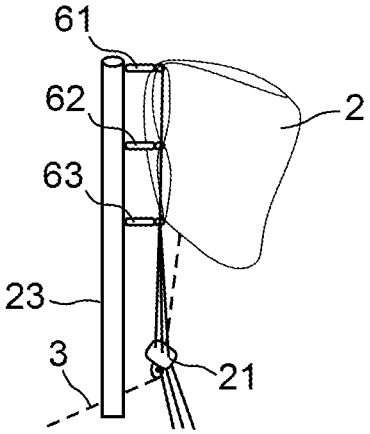
FIG. 15 is a folded sail according to the third embodiment of the invention.

When the slider 61 has reached its high position and the line 16 has been fully pulled, the centre of the leading edge of the wing 2 is blocked against the upper end of the mast, as in FIG. 14.

At this stage, the snap hook of the median slider 62 is passed around the pair 17 of folding lines 17*a* and 17*b* before displacing this slider 62 upwards to its reference position located at three-quarters of the height of the mast 23. The pair of lines 17 is here too pulled downwards, under the base unit 21, as shown in FIG. 14, to bring back the left and right portions of the leading edge of the wing against the mast.

Then, the snap hook of the lower slider 63 is passed around the pair 18 of lower folding lines 18*a*, 18*b*, and this lower slider 63 is displaced to its reference position located at mid-height of the mast. Additionally, the pair of lines 18 is pulled downwards under the base unit 21 to bring back the left and right ends of the wing against the mast, in such a way as to terminate the folding of the sail in accordance with FIG. 15.

The folding here too has been explained by successively manipulating the sliders 61, 62, 63 and the lines 16, 17 and 18, but the sliders and the lines can be actuated according to any suitable sequence, when this sequence terminates in placing the three sliders at their reference positions and in fully pulling the lines 16-18.

Once the wing has been folded, it can be furled, i.e. its trailing edge can be brought back as close as possible to the mast 23, in such a way as to reduce its size along a direction normal to the mast. This furling operation can be carried out using dedicated furling lines not shown that connect the leading edge 7 of the wing 2 to its trailing edge according to a pattern of the zig-zag type. The furling operation strictly speaking then consists of pulling the furling lines to bring back the entire trailing edge 8 as close as possible to the leading edge 7, i.e. as close as possible to the mast 23. The manipulation, i.e. the traction of the furling lines which are not shown is similar to that of the folding lines, these furling lines advantageously having an end carried by the base unit.

Figure 16:
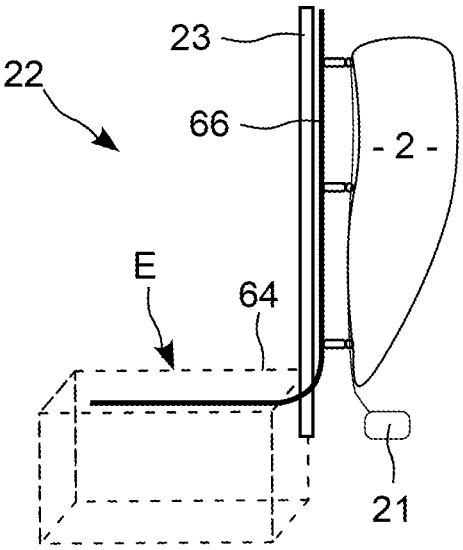
FIG. 16 is an overview of a system according to the invention fitted with a storage space under its mast shown at the beginning of the return of this sail into the storage space.
Figure 17:
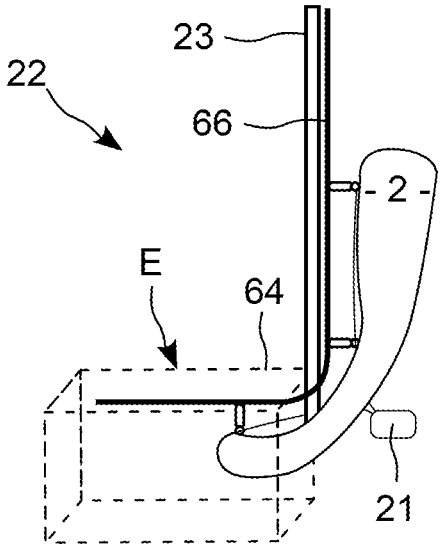
FIG. 17 is an overview of a system according to the invention fitted with a storage space at the foot of the mast shown during the return of this sail into the storage space.
Figure 18:
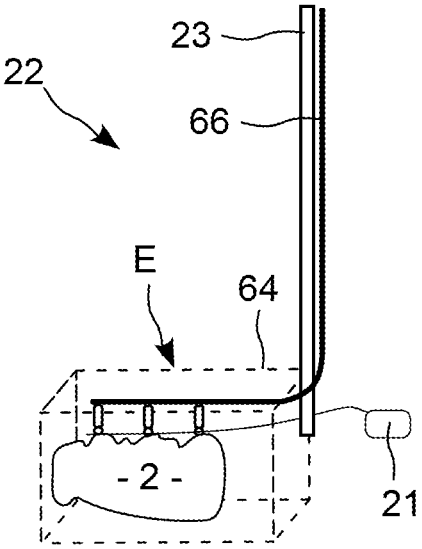
FIG. 18 is an overview of a system according to the invention fitted with a storage space under its mast shown when the sail has been fully brought back into the storage space.

Once the wing 2 has been furled, it is brought back in a storage space located at the foot of the mast 23, this space which is marked by E in FIGS. 16 to 18 is surrounded by a structure 64 located under or next to the mast 23.

More particularly, the sliders 61-63 are mounted in a rail 66 of which a straight portion is fitted on the mast 23, and which is extended under this mast 23 by a curved portion itself extended by a horizontal extension located in the upper portion of the storage space E.

Each slider 61-63 can thus be displaced along the rail from its reference position along the mast, to the horizontal extension for the rail located under the mast 23.

Once the wing 2 has been folded and furled against the mast 23, the system is controlled to displace the sliders 61-63 along their rail, downwards. During this displacement, the lower portion of the folded sail first reaches the foot of the mast 23, as in FIG. 16, to then be engaged in the curved portion, as can be seen in FIG. 17, so as to be positioned entirely along the horizontal portion of this rail, i.e. in the storage space E.

As can be seen in FIGS. 16 and 18, when the wing 2 is stored in the space E, it is pleated in order to occupy in the space E a length that is much less than its length when it is folded along the mast. The length of the folded wing along the mast corresponds to its half-span, and the length that it occupies once in the space E is about one third of this length in the example of the figures.

The sliders 61-63 are spaced closely together when they are in the space E, in comparison with the spacing that separates them along the mast when the wing is folded.

The sliders 61-63 can be maintained and displaced in the rail by means of a conveyor for example of a chain not shown running in this rail, and arranged to both limit the maximum spacing of the slides 61-63 with respect to one another, and to authorise them to be brought closer to one another when they are located in the horizontal portion of the rail. The lower portion of the rail is provided to allow the portions of chain separating the sliders to move away from the rail, so that this chain can occupy a serpentine configuration making it possible to bring the sliders closer to one another.

The arrangement that has just been described regarding the sliders of the third embodiment is similar in the case of the first and second embodiments: the pulleys 31-33 are then also provided as sliding in a rail by being maintained to one another by a chain making it possible to displace them when necessary.

Moreover, in the examples that have been described, the folding lines have their lower ends maintained to the base unit before folding, but these folding lines can have their free lower ends, to be simply grasped and connected to the ends of the control lines in the case of the first embodiment.

Furthermore, the folding lines are dedicated lines in the examples that have been described, but these folding lines can also form hangers of the wing, having in this case two additional function.

Generally, the unfolding of the wing is obtained by carrying out the same sequences as for the folding of it, but in reverse order. Before disconnection of the lines between the plate 26 and the base unit 21, the return lines 51-53 make it possible to bring back the snap hooks 47-49 in the vicinity of the plate and of the base unit.

What is claimed is:

1. Traction system, notably for a ship, comprising a sail (1) and a fixed station (22) including a mast (23) and a winch connected to the sail (1) by a traction cable (3), comprising:

several folding lines (16-18) each one having an end fastened to a leading edge (7) of the sail (1) by being spaced apart from one another along this leading edge (7);

means for pulling at least three folding lines (16-18), so as to bring back the ends of these folding lines fastened to the leading edge (7) against the mast (23) to at least two different heights along this mast (23).

2. System according to claim 1 comprising:

a base unit (21) carried by the traction cable (3), each folding line (16-18) having an end carried by this base unit (21);

a socket (41) fitted to the fixed station (22) and receiving the base unit (21) when the sail (1) is brought back by the winch;

deflection members such as pulleys (31-33) or snap hooks fitted to the mast (23) to receive the folding lines (16-18);

means for pulling each folding line (16-18) received in a deflection member (31-33), so as to bring back the upper end of each folding line against the mast (23).

3. System according to claim 2, wherein the means for pulling each folding line (16-18) comprise control lines (27-29) that run alongside the mast (23) by having passed through the deflection members (31-33) before bringing the sail (1) back with the winch, these control lines (27-29) then being connected to the folding lines (16-18) to pull on these folding lines (16-18).

4. System according to claim 3, wherein the fixed station (22) comprises a plate (26) and wherein each control line (27-29) comprises an end fitted with a connection member (47-49) fastened to this plate (26) on hold before bringing the sail (1) back with the winch.

5. System according to claim 3, wherein the fixed station (22) comprises winches to pull on each control line (27-29).

6. System according to claim 3, wherein each control line (27-29) has an end fitted with a connection member (47-49) at an end of a folding line (16-18).

7. System according to claim 3, wherein each control line (27-29) has an end fitted with a connection member (47-49) to a folding line portion (16-18) located between the ends of this folding line (16-18).

8. System according to claim 1 or 2, wherein the mast (23) is fitted with sliders (61-63) each carrying a deflection member able to be connected to a folding line portion (16-18) located between the ends of this folding line (16-18) by surrounding it, each slider being mobile along the mast, and means for pulling folding lines (16-18) received in a connection member.

* * * * *